US009909282B2

(12) United States Patent
Kumamoto et al.

(10) Patent No.: US 9,909,282 B2
(45) Date of Patent: Mar. 6, 2018

(54) WORK VEHICLE

(71) Applicant: KOMATSU LTD., Tokyo (JP)

(72) Inventors: Kazeto Kumamoto, Hirakata (JP); Masato Kageyama, Oyama (JP)

(73) Assignee: KOMATSU LTD., Tokyo (JP)

( * ) Notice: Subject to any disclaimer, the term of this patent is extended or adjusted under 35 U.S.C. 154(b) by 271 days.

(21) Appl. No.: 14/771,244

(22) PCT Filed: Jan. 29, 2015

(86) PCT No.: PCT/JP2015/052581
§ 371 (c)(1),
(2) Date: Aug. 28, 2015

(87) PCT Pub. No.: WO2016/121069
PCT Pub. Date: Aug. 4, 2016

(65) Prior Publication Data

US 2016/0362872 A1 Dec. 15, 2016

(51) Int. Cl.
*E02F 9/26* (2006.01)
*E02F 9/08* (2006.01)
(Continued)

(52) U.S. Cl.
CPC ..... *E02F 9/26* (2013.01); *E02F 3/32* (2013.01); *E02F 9/0808* (2013.01);
(Continued)

(58) Field of Classification Search
CPC ... E02F 9/26; E02F 9/0808; E02F 3/32; E02F 9/0883; E02F 9/14; E02F 9/0833; E02F 9/265
See application file for complete search history.

(56) References Cited

U.S. PATENT DOCUMENTS

2006/0085116 A1 4/2006 Suzuki et al.
2012/0067660 A1* 3/2012 Kashu ..... B60K 13/04 180/296
(Continued)

FOREIGN PATENT DOCUMENTS

DE 11 2013 000 217 B4 10/2015
EP 2 712 967 A1 4/2014
(Continued)

OTHER PUBLICATIONS

The Office Action for the corresponding Japanese application No. 2015-510208, dated Feb. 16, 2016.
(Continued)

*Primary Examiner* — Michael S Lowe
(74) *Attorney, Agent, or Firm* — Global IP Counselors, LLP

(57) ABSTRACT

The hydraulic excavator comprises a revolving frame, a boom, a rotary encoder, and a link member. The revolving frame has a base plate and a first vertical plate and second vertical plate that are opposite each other and rise from the base plate. The boom is rotatably supported by the first vertical plate and the second vertical plate. The rotary encoder is provided at a position that is different from a position of the rotational axis of the boom, and senses the rotational angle of the boom according to the rotation of the boom. The link member transmits displacement of the boom to the rotary encoder.

5 Claims, 15 Drawing Sheets

(51) Int. Cl.
*E02F 9/14* (2006.01)
*E02F 3/32* (2006.01)

(52) U.S. Cl.
CPC ..... *E02F 9/0833* (2013.01); *E02F 9/0883* (2013.01); *E02F 9/14* (2013.01); *E02F 9/265* (2013.01)

(56) References Cited

U.S. PATENT DOCUMENTS

| | | | |
|---|---|---|---|
| 2015/0066312 | A1 | 3/2015 | Sakuda et al. |
| 2016/0002884 | A1 | 1/2016 | Nakamura |

FOREIGN PATENT DOCUMENTS

| | | | |
|---|---|---|---|
| JP | 2000-170218 | A | 6/2000 |
| JP | 2004-278288 | A | 10/2004 |
| JP | 5401616 | B1 | 1/2014 |
| JP | 2014-66074 | A | 4/2014 |
| JP | 5629015 | B1 | 10/2014 |
| JP | 2014-214539 | A | 11/2014 |

OTHER PUBLICATIONS

The International Search Report for the corresponding international application No. PCT/JP2015/052581, dated Mar. 30, 2015.
The International Search Report for the corresponding international application No. PCT/JP2015/052581, dated Apr. 7, 2015.

* cited by examiner

WORK VEHICLE

CROSS-REFERENCE TO RELATED APPLICATIONS

This application is a U.S. National stage application of International Application No. PCT/JP2015/052581, filed on Jan. 29, 2015.

BACKGROUND

Field of the Invention

The present invention relates to a work vehicle.

A hydraulic excavator or other such work vehicle is equipped with a lower traveling unit having crawler belts, and an upper structure having a revolving frame, a work implement, and so forth. The work implement in the case of a hydraulic excavator is constituted by a boom, an arm, a bucket, and so on. The boom is provided rotatably with respect to the revolving frame, the arm is provided rotatably with respect to the boom, and the bucket is provided rotatably with respect to the arm. The boom, arm, and bucket are rotated by hydraulic cylinders.

With a hydraulic excavator configured like this, when automatic excavation control is performed, the stroke length of the hydraulic cylinders is measured to sense the position and orientation of the work implement.

For example, in Japanese Patent No. 5,401,616, a cylinder with which stroke length can be sensed is used for the hydraulic cylinder that rotates the boom. This cylinder is configured to sense the stroke position of the hydraulic cylinder from the rotation of a roller on a cylinder rod. Since a tiny amount of slip occurs between this roller and the cylinder rod, there is a discrepancy between the stroke length obtained from the sensing result of the position sensor and the actual stroke length. To correct this error, a rotary encoder is provided (an example of an angle sensor) to the rotational axis of the boom. The point when the angle of the boom reaches a predetermined reference angle is detected by the rotary encoder, and the error that occurs in the cylinder is corrected.

SUMMARY

When a rotary encoder is provided to the rotational axis of a boom, however, the rotary encoder is disposed on the outside of a vertical plate of the frame supporting the boom. Therefore, the rotary encoder ends up protruding outward from the vertical plate, and if the rotary encoder is disposed on the outside of the vertical plate, it may interfere with parts that are disposed to the side of the vertical plate, so the layout position of these parts is limited. Accordingly, some parts cannot be disposed on the outside of the vertical plate, and the space on the outside of the vertical plate may not be utilized effectively.

It is an object of the present invention to provide a work vehicle with which the space outside the vertical plate can be utilized effectively.

The work vehicle pertaining to a first exemplary embodiment of the present invention comprises a frame, a boom, an angle sensor, and a link member. The frame has a first vertical plate and a second vertical plate that are opposite each other. The boom is rotatably supported by the first vertical plate and the second vertical plate. The angle sensor is provided at a different position from a position of a rotational axis of the boom. The link member transmits a rotational angle of the boom to the angle sensor according to a rotation of the boom.

Thus providing a link member that transmits the rotational angle of the boom to the angle sensor allows the angle sensor to be installed at a different position from that of the rotational axis of the boom. Consequently, the position of the angle sensor can be moved around the rotational axis of the boom to suit the parts disposed near the rotational axis of the boom. This allows the space to the side of the rotational axis (to the outside of the first vertical plate) to be utilized effectively.

Also, in recent years it has become preferable for an exhaust treatment apparatus that treats exhaust gas from the engine to be mounted in work vehicles. In this case, there needs to be enough space for a reductant tank to be installed on the upper structure, and with the work vehicle discussed above, the reductant tank can be installed in the space to the outside of the first vertical plate.

The work vehicle pertaining to a second exemplary embodiment of the present invention is the work vehicle pertaining to the first exemplary embodiment of the present invention, wherein the angle sensor is disposed higher than the rotational axis.

This allows the parts to be disposed near and to the side of the first vertical plate, so the space to the outside of the first vertical plate can be utilized effectively.

The work vehicle pertaining to a third exemplary embodiment of the present invention is the work vehicle pertaining to the first exemplary embodiment of the present invention, further comprising a tank. The tank is disposed on the frame and to a side of the first vertical plate. The angle sensor is disposed higher than the tank.

This allows a reductant tank, a fuel tank, or another such tank to be disposed near and to the side of the first vertical plate, so the space to the outside of the first vertical plate can be utilized effectively.

The work vehicle pertaining to a fourth exemplary embodiment of the present invention is the work vehicle pertaining to the third exemplary embodiment of the present invention, wherein the tank is a reductant tank.

This allows a reductant tank to be disposed near and to the side of the first vertical plate.

The work vehicle pertaining to a fifth exemplary embodiment of the present invention is the work vehicle pertaining to the first exemplary embodiment of the present invention, further comprising a support member. The support member is a flat support member that is fixed to the first vertical plate and supports the angle sensor. The angle sensor is disposed on the second vertical plate side of the support member.

Since the angle sensor is thus disposed on the second vertical plate side of the support member, the reductant tank and other such parts can be disposed near and to the outside of the first vertical plate, and the spacing to the outside of the first vertical plate can be utilized effectively.

The work vehicle pertaining to a sixth exemplary embodiment of the present invention is the work vehicle pertaining to the first exemplary embodiment of the present invention, wherein the angle sensor is disposed on the second vertical plate side of the first vertical plate.

Since the angle sensor is thus disposed on the second vertical plate side of the first vertical plate, the reductant tank and other such parts can be disposed near and to the outside of the first vertical plate, and the spacing to the outside of the first vertical plate can be utilized effectively.

The work vehicle pertaining to a seventh exemplary embodiment of the present invention is the work vehicle pertaining to the first exemplary embodiment of the present invention, wherein the link member has a first member that is linked to the angle sensor, and a second member that is linked to the boom. The first member and the second member are mutually rotatably linked. The first member is disposed parallel to a straight line that connects the rotational axis of the boom with a linked portion of the second member and the boom. The second member is disposed parallel to a straight line that connects the rotational axis of the boom with a linked portion of the angle sensor and the first member.

This constitutes a parallel link, so the rotational angle of the boom and the angle sensed by the angle sensor are in a one-to-one correspondence, and the rotational angle of the boom will be the same as the angle sensed by the angle sensor. The term "parallel" here permits a certain amount of mechanical error.

The present invention provides a work vehicle with which the space outside a vertical plate can be utilized effectively.

DETAILED DESCRIPTION OF EXEMPLARY EMBODIMENTS

The work vehicle pertaining to an exemplary embodiment of the present invention will now be described through reference to the drawings.

1. Configuration

1-1. Overall Configuration of Hydraulic Excavator

Figure 1:
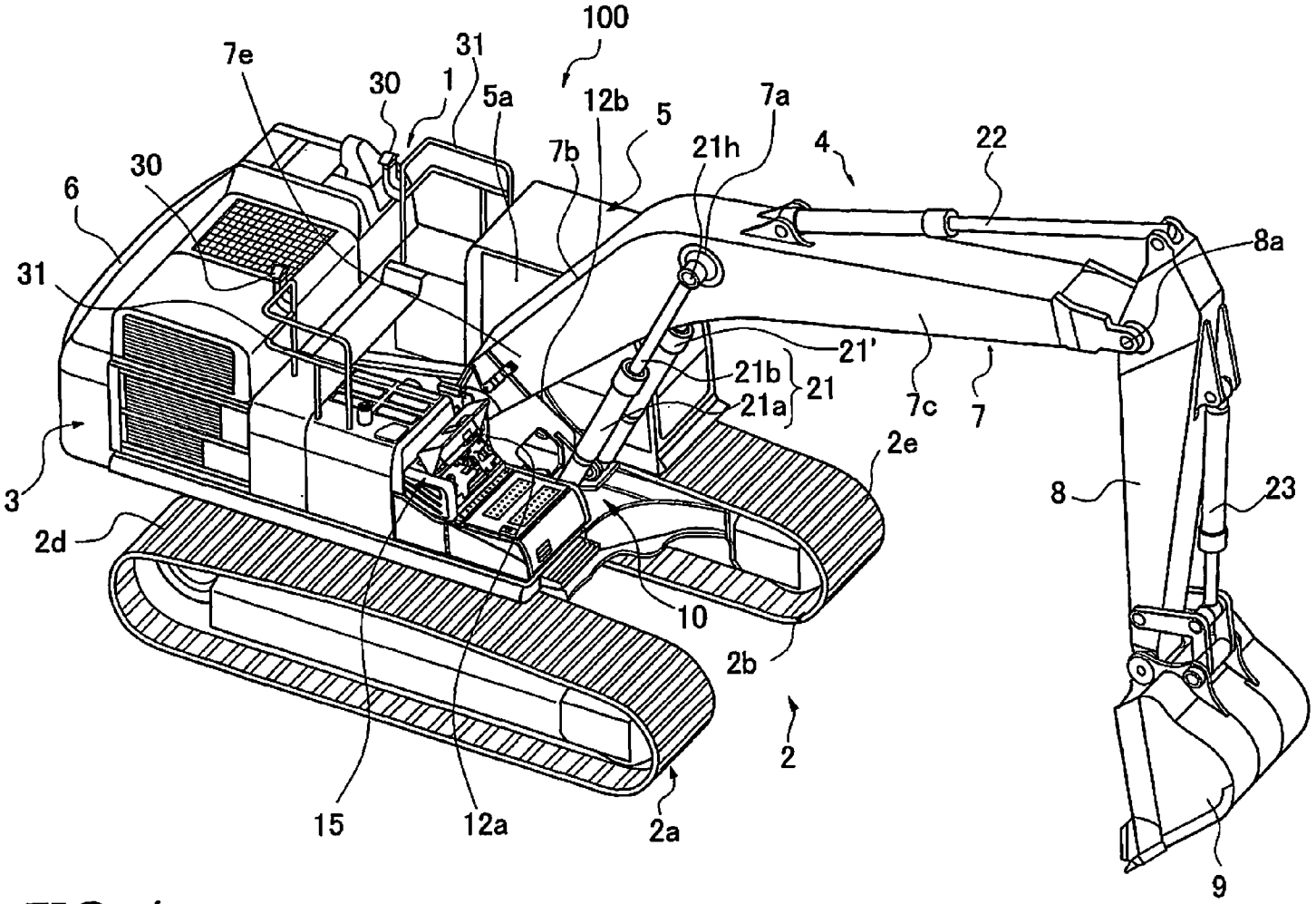
FIG. 1 is an oblique view of a hydraulic excavator pertaining to an exemplary embodiment of the present invention.

FIG. 1 is an oblique view of a hydraulic excavator 100 pertaining to an exemplary embodiment of the present invention. This hydraulic excavator 100 comprises a vehicle body 1 and a work implement 4.

The vehicle body 1 has a traveling unit 2 and a revolving unit 3. The traveling unit 2 has a pair of travel devices 2*a* and 2*b*. The travel devices 2*a* and 2*b* have crawler belts 2*d* and 2*e*, respectively. The crawler belts 2*d* and 2*e* are driven by drive force from an engine, which propels the hydraulic excavator 100.

The revolving unit 3 has a revolving frame 10 that is installed on the traveling unit 2, and is able to revolve with respect to the traveling unit 2. A cab 5 (operator's compartment) is provided above the revolving frame 10, in the left-front position of the revolving unit 3.

A grab bar 31 is installed rearward of the cab 5, and a GNSS (Global Navigation Satellite System) antenna 30 is provided to the grab bar 31. The GNSS antenna 30 obtains information about the current position of the work vehicle.

In the description of the overall configuration, the term "longitudinal direction" refers to the longitudinal direction of the cab 5. The longitudinal direction of the vehicle body 1 coincides with the longitudinal direction of the cab 5, that is, the revolving unit 3. The left-right direction or "to the side" means in the width direction of the vehicle body 1.

The revolving unit 3 has a reductant tank 15, a fuel tank, an engine, and so forth disposed on the revolving frame 10, and a counterweight 6 is provided to the rear.

The work implement 4 has a boom 7, an arm 8, and an excavation bucket 9, and is attached in the front-center position of the revolving unit 3. The work implement 4 is disposed on the right side of a right side face 5*a* of the cab 5. The proximal end of the boom 7 is rotatably linked to the revolving unit 3. The distal end of the boom 7 is rotatably linked to the proximal end of the arm 8. The distal end of the arm 8 is rotatably linked to the excavation bucket 9.

Boom cylinders 21 and 21' are provided between the revolving frame 10 and the boom 7. A cylinder linking component 7*a* to which the boom cylinder 21 is linked is provided in the approximate center of the boom 7. The boom 7 has a first boom component 7*b* on the rear side from the cylinder linking component 7*a*, and a second boom component 7*c* on the front side from the cylinder linking component 7*a*. The boom 7 is bent to stick up near the cylinder linking component 7*a*.

An arm cylinder 22 is provided between the boom 7 and the arm 8. A bucket cylinder 23 is provided between the arm 8 and the excavation bucket 9. The boom cylinder 21, the arm cylinder 22, and the bucket cylinder 23 are all hydraulic cylinders. When these hydraulic cylinders are driven, the boom 7, the arm 8, and the excavation bucket 9 rotate and the work implement 4 is driven. This is how excavation and other such work is carried out.

1-2. Configuration Near Boom Proximal End

Figure 2A:
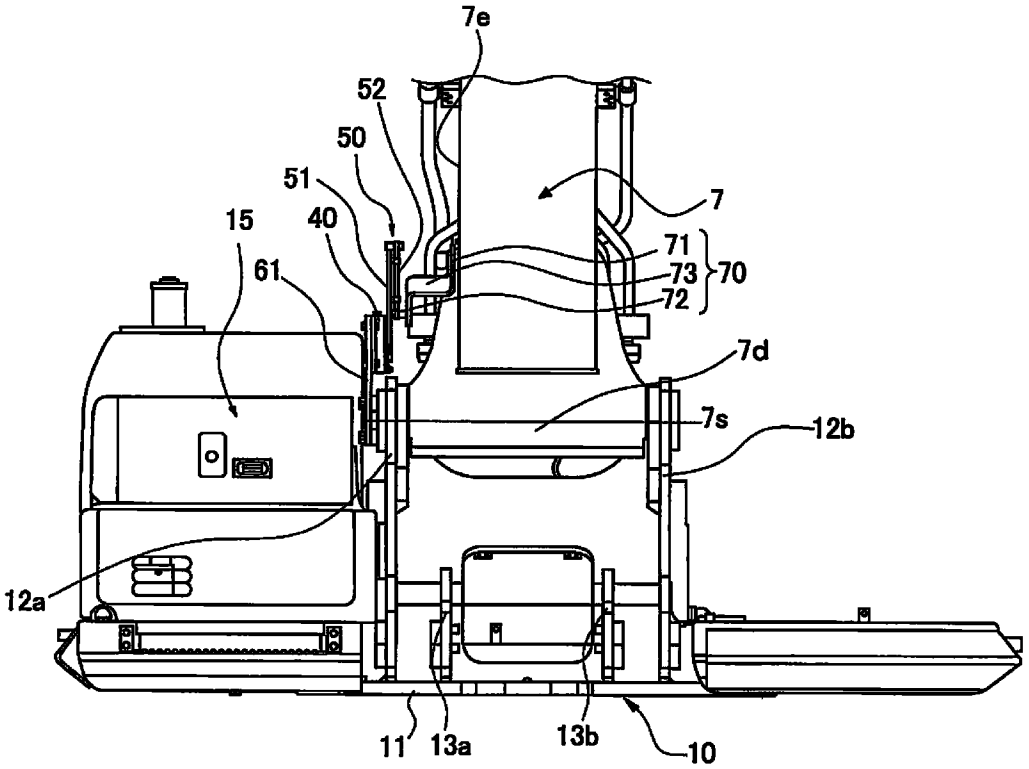
FIG. 2A is a front view of the hydraulic excavator in FIG. 1.
Figure 2B:
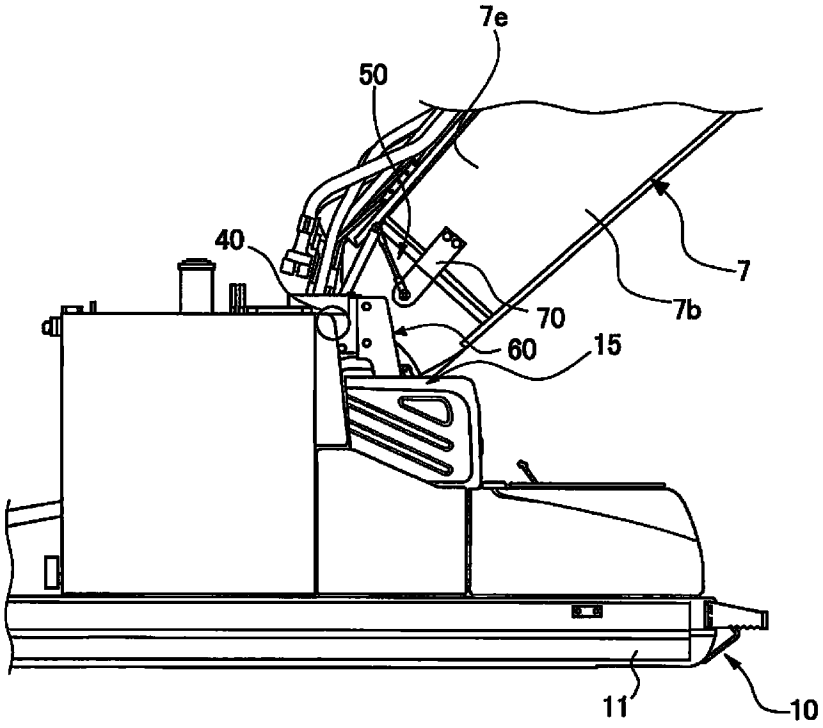
FIG. 2B is a side view of the hydraulic excavator in FIG. 1.
Figure 3:
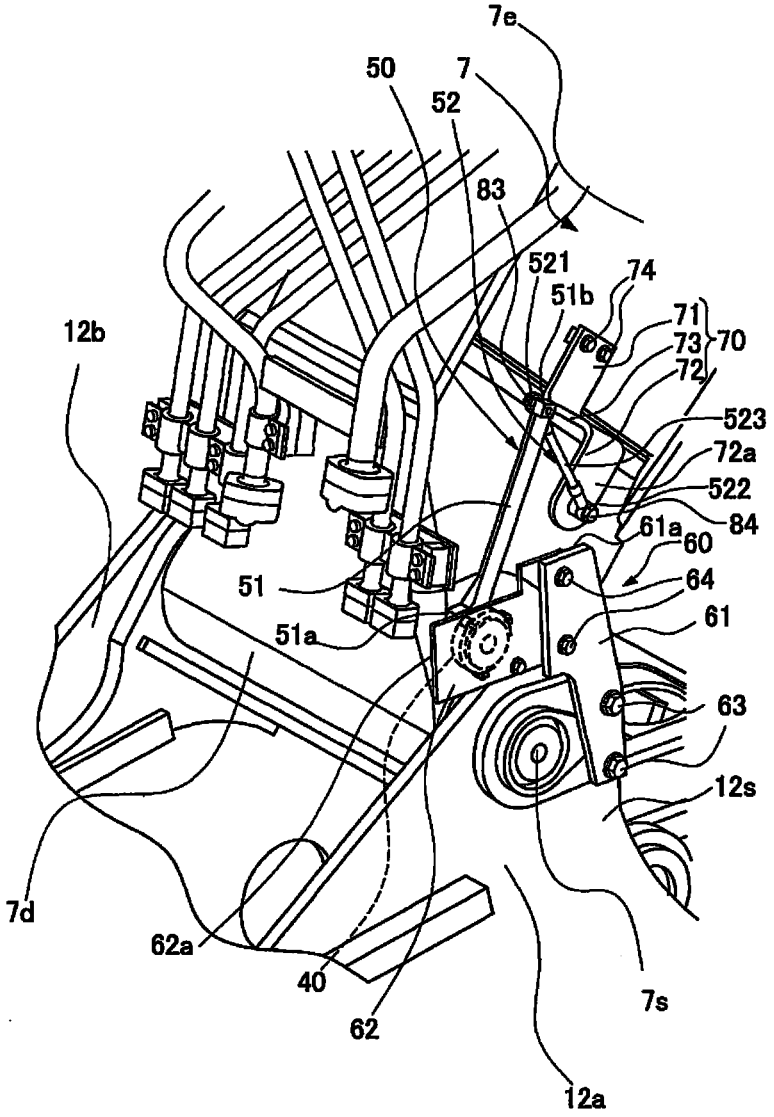
FIG. 3 is a partial enlarged oblique view near the proximal end of the boom of the hydraulic excavator in FIG. 1.

FIG. 2A is a front view of the hydraulic excavator 100 shown in FIG. 1. The boom cylinders 21 and 21', the cab 5, and so forth are not depicted in FIG. 2A. FIG. 2B is a side view of FIG. 2A. FIG. 3 is a partial enlarged oblique view of near the proximal end of the boom 7. In FIG. 3, the reductant tank 15 (discussed below) is omitted for the sake of clarity.

As shown in FIG. 2A, the revolving frame 10 has a base plate 11 and a paired first vertical plate 12*a* and second vertical plate 12*b*. The base plate 11 is disposed above the traveling unit 2. The first vertical plate 12*a* and the second vertical plate 12*b* rise up from the base plate 11 in the center part of the front end of the base plate 11. The first vertical plate 12*a* and the second vertical plate 12*b* are disposed parallel to each other in the longitudinal direction, and are opposite each other. The first vertical plate 12*a* is on the right side, and the second vertical plate 12*b* on the left side.

As shown in FIGS. 2A and 3, the proximal end 7*d* of the boom 7 is disposed between the first vertical plate 12*a* and the second vertical plate 12*b*, and is rotatably supported by the first vertical plate 12*a* and the second vertical plate 12*b*. The rotational axis of the boom 7 is shown as the axis 7*s* in FIGS. 2A and 3.

As shown in FIGS. 1, 2A, and 2B, the reductant tank 15 is provided near the first vertical plate 12*a*, on the right side of the first vertical plate 12*a*. Part of the reductant tank 15 is located at the same height as the axis 7*s*. In side view, the reductant tank 15 is disposed superposed with the axis 7*s*.

A precursor of a reductant used to reduce nitrogen oxides in the exhaust from the engine is held in the reductant tank 15. This reductant precursor will be hereafter referred to simply as a "reductant." An aqueous solution of urea is an example of a reductant.

Figure 4:
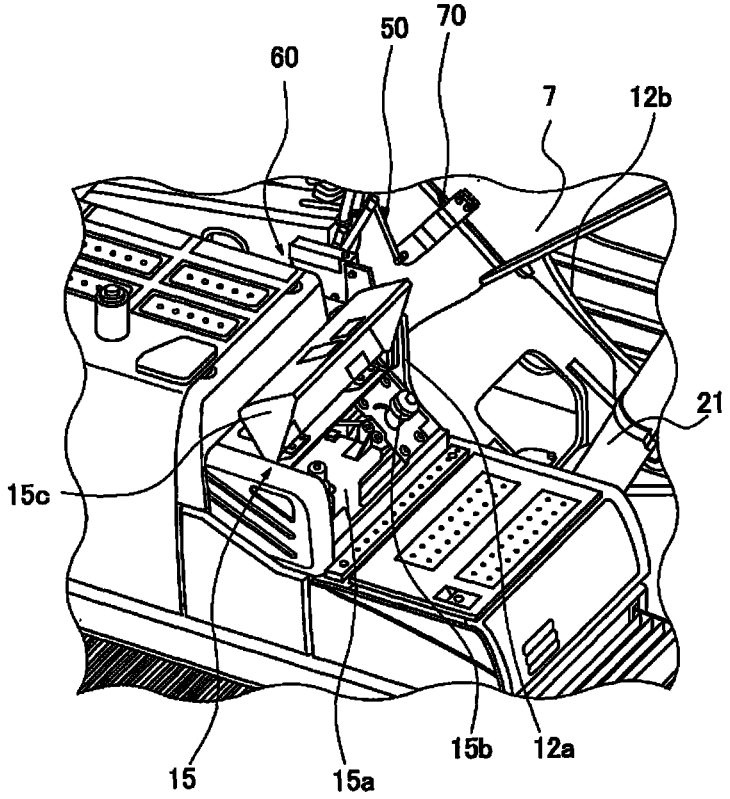
FIG. 4 is a partial enlarged oblique view near the proximal end of the hydraulic excavator in FIG. 1 in which a cover of the redundant tank is open.
Figure 5:
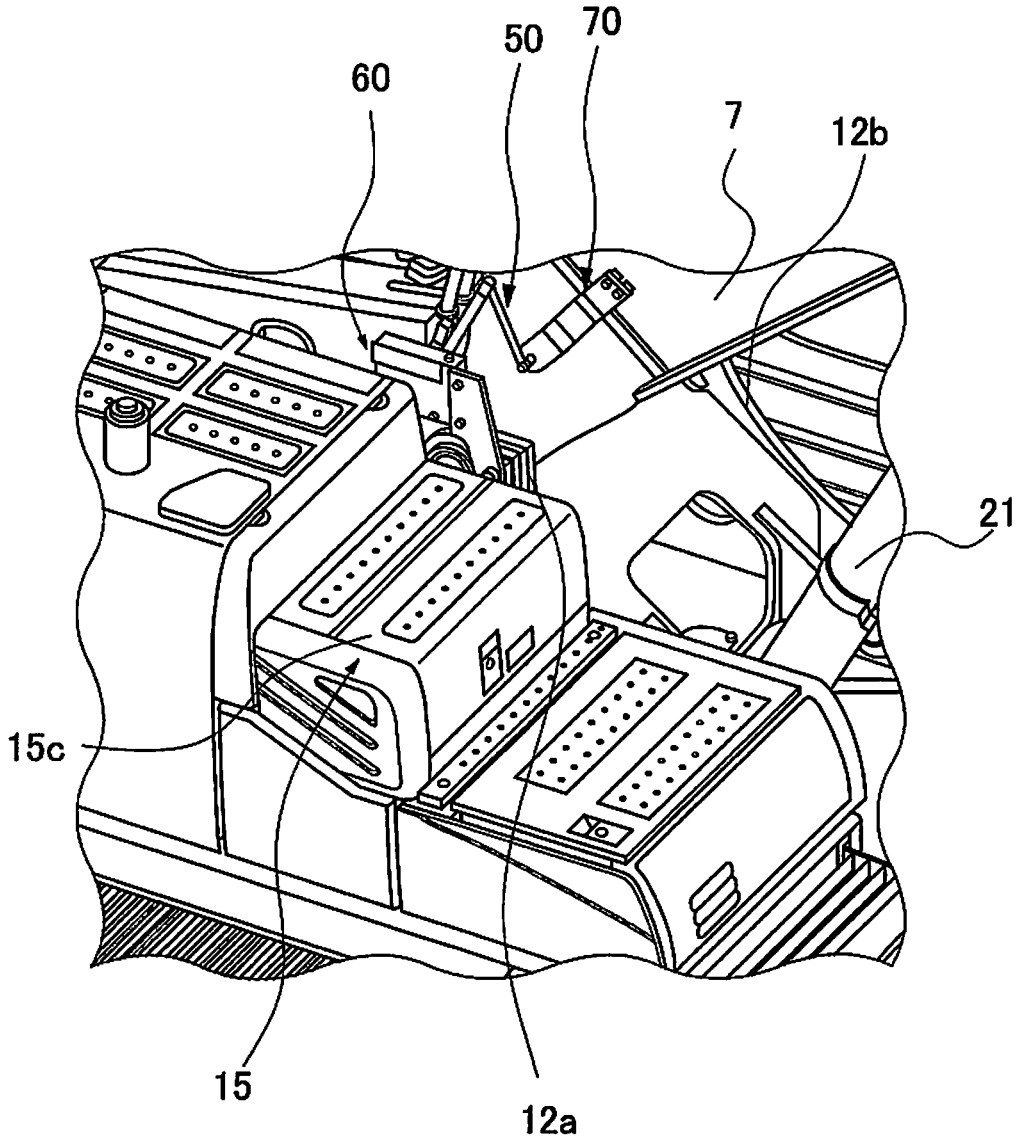
FIG. 5 is an oblique view of the state when the cover of the reductant tank in FIG. 4 is closed.

FIG. 4 is a partial enlarged oblique view of near the proximal end of the hydraulic excavator shown in FIG. 1. FIG. 5 shows the state when the cover of the reductant tank 15 is closed from the state shown in FIG. 4.

As shown in FIGS. 4 and 5, the reductant tank 15 has a tank body 15*a*, a water inlet 15*b*, and a cover 15*c* that can be opened and closed and covers the tank body 15*a* and water inlet 15*b*. The water inlet 15*b* is located on the left side of the tank body 15*a*. The reductant supplied from the water inlet 15*b* is held in the tank body 15*a*. The cover 15*c* is configured so that the front side can rotate up and down around the rear end side.

As shown in FIGS. 2A, 2B, and 3, a rotary encoder 40 for correcting sensing error in the rotational angle of the boom 7 by the boom cylinder 21 is provided above the first vertical plate 12*a* and higher than the reductant tank 15 (see FIG. 2B). The rotary encoder 40 is linked to a link member 50 for transmitting the rotation of the boom 7. The rotary encoder 40 and the link member 50 will be discussed in detail below, and the boom cylinder 21 corrected by the rotary encoder 40 will be described.

1-3. Boom Cylinder

Figure 6A:
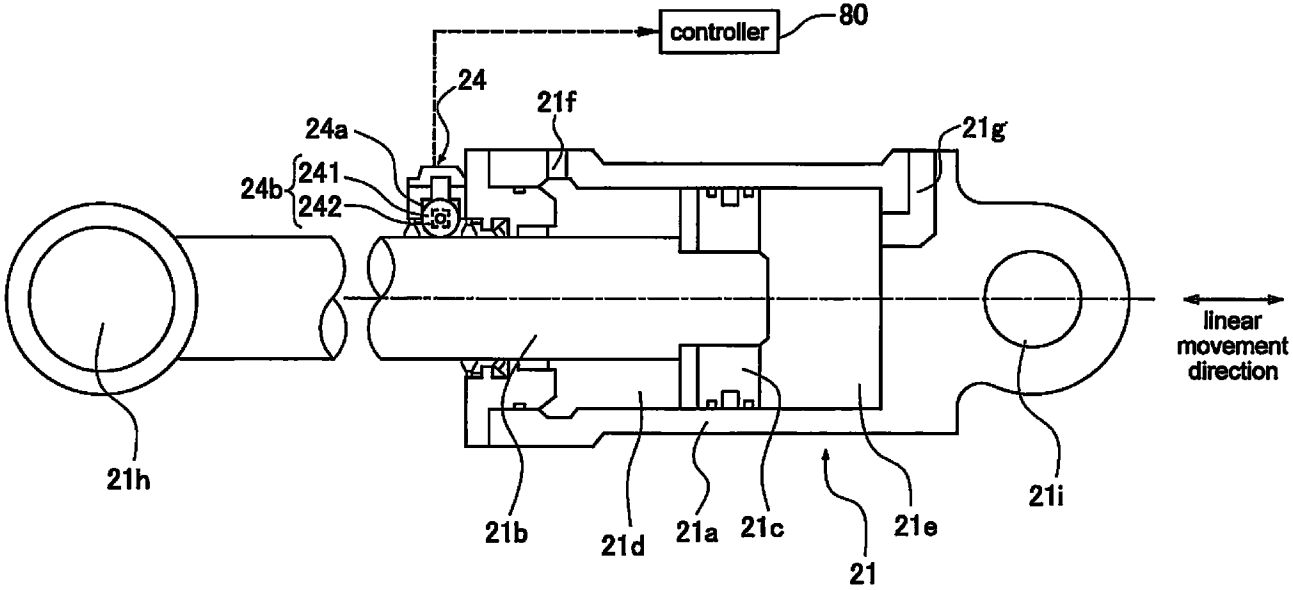
FIG. 6A shows the configuration of a boom cylinder in the hydraulic excavator in FIG. 1.

FIG. 6A is a simplified view of the configuration of the boom cylinder 21. The boom cylinder 21 used in the hydraulic excavator 100 in this exemplary embodiment is a cylinder that allows the stroke of a cylinder rod 21*b* to be sensed. As shown in FIG. 1, two cylinders are provided flanking the boom 7, and at least one of these cylinders should be capable of sensing the stroke. In this exemplary embodiment, the boom cylinder 21 that is capable of sensing the stroke is provided on the right side, and the boom cylinder 21' that does not have a stroke sensing function (a position sensor 24 (discussed below)) is provided on the left side.

As shown in FIGS. 1 and 6A, the boom cylinder 21 has a cylinder tube 21*a*, the cylinder rod 21*b*, a piston 21*c*, and the position sensor 24.

The piston 21*c* is disposed slidably within the cylinder tube 21*a*. The piston 21*c* is fixed to the cylinder rod 21*b*. The distal end 21*h* of the cylinder rod 21*b* is rotatably linked to the cylinder linking component 7*a* provided in the approximate center of the boom 7. The lower end 21*i* of the cylinder tube 21*a* is rotatably fixed to a cylinder linking plate 13*a* shown in FIG. 2A. As shown in FIG. 2A, the cylinder linking plate 13*a* rises up near the center at the front end of the base plate 11. A cylinder linking plate 13*b* rises up from the base plate 11, opposite the cylinder linking plate 13*a*. The lower end of the cylinder tube of the boom cylinder 21' is disposed on this cylinder linking plate 13*b*.

The space inside the cylinder tube 21*a* is divided by the piston 21*c* into a first space 21*d* and a second space 21*e*. The first space 21*d* is a space on the side where the cylinder rod 21*b* is disposed, and the second space 21*e* is a space on the opposite side from the first space 21*d*, flanking the piston 21*c*.

A first support port 21*f* that supplies hydraulic fluid from a hydraulic pump to the first space 21*d*, and a second supply port 21*g* that supplies hydraulic fluid from a hydraulic pump to the second space 21*e* are formed in the cylinder tube 21*a*.

When hydraulic fluid is supplied to the second space 21*e*, the pressure of the hydraulic fluid moves the piston 21*c* through the cylinder tube 21*a* toward the opposite side from the lower end 21*i* (to the left in FIG. 6A). The movement of the piston 21*c* also moves the cylinder rod 21*b* and extends the boom cylinder 21. When the boom cylinder 21 extends, the boom 7 linked to the distal end of the cylinder rod 21*b* rotates upward around the axis 7*s*. On the other hand, when hydraulic fluid is supplied to the first space 21*d* and the boom cylinder 21 retracts, the boom 7 rotates downward around the axis 7*s*.

Figure 6B:
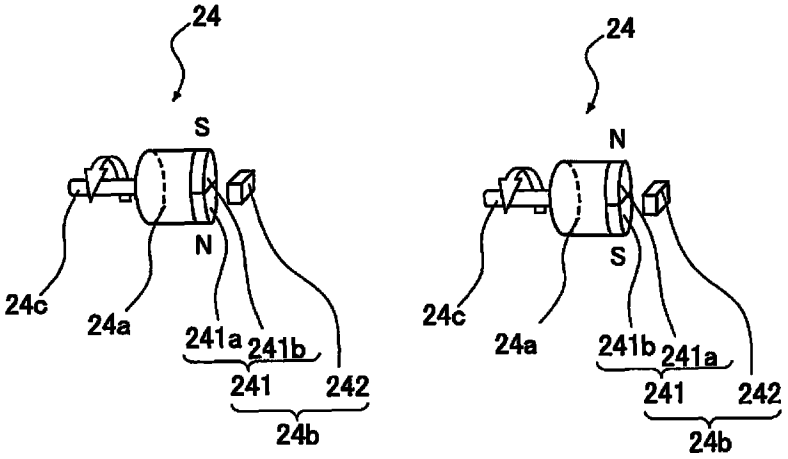
FIG. 6B illustrates a position sensor in the boom cylinder in FIG. 6A.

FIG. 6B shows the configuration of the position sensor 24. The position sensor 24 has a roller 24*a* and a rotation sensor 24*b*. The peripheral surface of the roller 24*a* is in contact with the surface of the cylinder rod 21*b*, and the position sensor 24 rotates around an axis 24*c* along with the movement of the cylinder rod 21*b*. The amount of rotation of the roller 24*a* is sensed to ascertain the stroke amount of the cylinder rod 21*b*.

As shown in FIG. 6B, the rotation sensor 24*b* has a cylindrical magnet 241 and a Hall integrated circuit (IC) 242. The magnet 241 is provided coaxially with the roller 24*a*, and rotates along with the roller 24*a*. The magnet 241 is made up of a semi-cylindrical N pole 241*a* and a semi-cylindrical S pole 241*b*. The Hall IC 242 is provided at a location along the rotational axis of the magnet 241, and is a sensor that senses magnetic flux density as an electrical signal.

The rotation of the roller 24*a* causes the magnet 241 to rotate, and the magnetic force sensed by the Hall IC 242 fluctuates, with each rotation being one period. A signal representing this magnetic force fluctuation is outputted to a controller 80, and the amount of rotation of the roller 24*a* is computed. As a result, the stroke amount of the cylinder rod 21*b* is sensed, and the rotational angle of the boom 7 is calculated.

With the above-mentioned boom cylinder 21, error is sometimes caused by slippage between the roller 24*a* and the cylinder rod 21*b*, and this error is corrected on the basis of the angle sensed by the rotary encoder 40.

1-4. Rotary Encoder

Figure 7A:
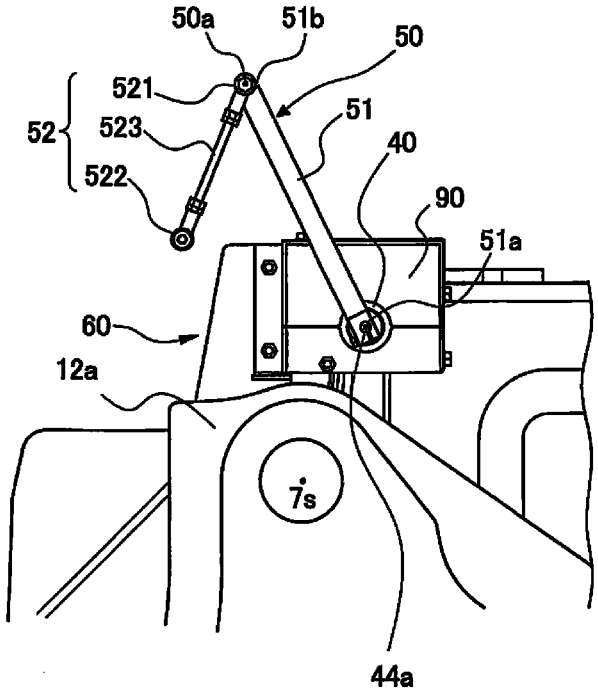
FIG. 7A is a side view of near the rotary encoder in the hydraulic excavator in FIG. 1.
Figure 7B:
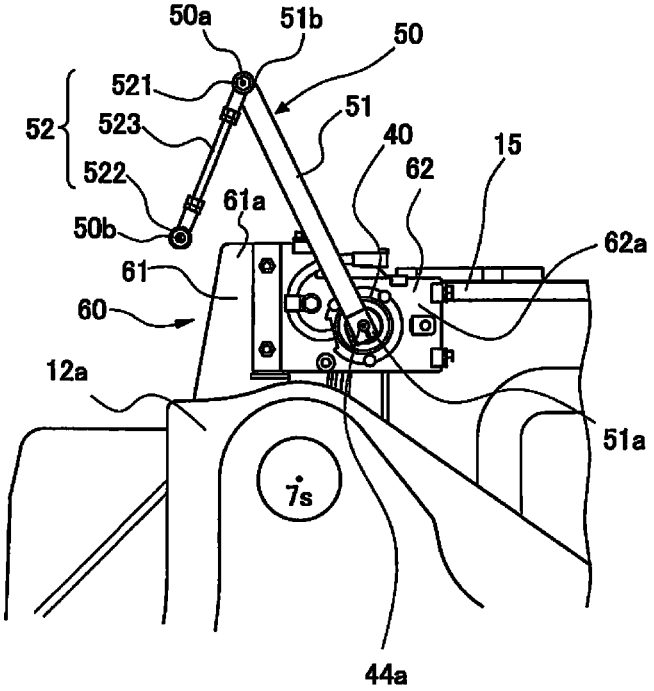
FIG. 7B is a side view of the state when the cover that covers the rotary encoder has been removed from FIG. 7A.

FIG. 7A is a side view of the first vertical plate 12*a*, as seen from the left side. FIG. 7B is a side view of the state when a cover 90 that covers the rotary encoder 40 has been removed.

As shown in FIGS. 3 and 7B, the rotary encoder 40 is fixed to the first vertical plate 12*a* via a bracket 60.

As shown in FIG. 3, the bracket 60 has a first bracket member 61 and a second bracket member 62. The first bracket member 61 is a flat member, and is fixed to the portion of the first vertical plate 12*a* that is ahead of the axis 7*s*. The first bracket member 61 is fixed by bolts 63 to a face 12*s* on the outside of the first vertical plate 12*a* (the face on the opposite side from the second vertical plate 12*b*). The first bracket member 61 extends upward.

The second bracket member 62 is a flat member, and is fixed by bolts 64 to an inner face 61*a* of the first bracket member 61 (the face on the second vertical plate 12*b* side). The second bracket member 62 is disposed to the rear of the first bracket member 61.

The rotary encoder 40 is disposed on an inner face 62*a* of the second bracket member 62 (the one that faces toward the second vertical plate 12*b*). As shown in FIG. 7A, the rotary encoder 40 is covered by the cover 90 from the inside. This keeps out dirt, dust, and the like.

The sensing performed by the rotary encoder 40 is well known. An example of the sensing method is to use a light receiving element to receive light that passes through a slit, and then sense the angle on the basis of the timing at which the light is received.

1-5. Link Member 50

As shown in FIG. 3, the link member 50 is fixed to the boom 7 via a link fixing member 70 that is fixed to a side face of the boom 7. As shown in FIG. 3, the link member 50 has a first member 51 and a second member 52.

1-5-1. First Link Member

The first member 51 is in the form of a slender plate. Of the two ends of the first member 51, a first end 51*a* (see FIG. 3) is connected to the shaft 44 of the rotary encoder 40.

The second member 52 has a first ball joint 521, a second ball joint 522, and a connecting member 523 that links the first ball joint 521 and the second ball joint 522.

1-5-2. Second Link Member

Figure 8:
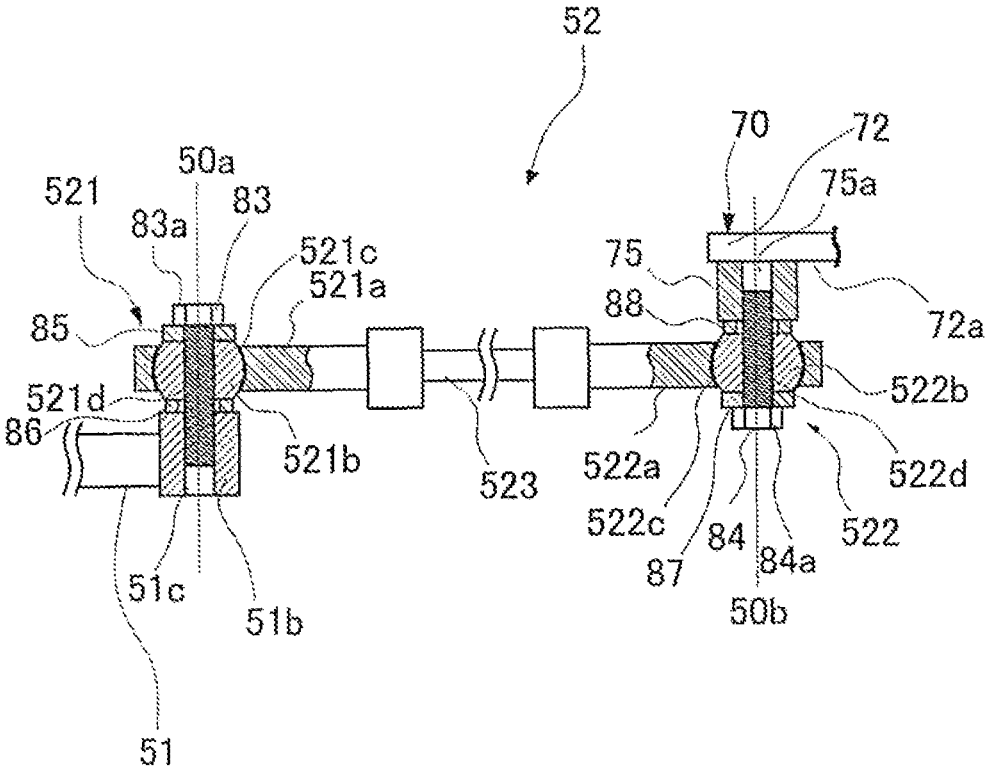
FIG. 8 is a cross section of the configuration of a second member of the link component in FIG. 3.

FIG. 8 is a simplified diagram of the second member 52 shown in FIG. 3, as seen from above, and is a partial cross section of the first ball joint 521 and the second ball joint 522.

The first ball joint 521 is rotatably fixed by a bolt 83 to a second end 51*b* of the first member 51. The second ball joint 522 is fixed by a bolt 84 to the link fixing member 70.

The first ball joint 521 has a support component 521*a* and a ball component 521*b*. The support component 521*a* is connected to the connecting member 523. A substantially spherical support space 521*c* is formed in the distal end portion of the support component 521*a*, and the ball component 521*b* is rotatably supported in this support space 521*c*. A through-hole 521*d* is formed in the ball component 521*b*, and the bolt 83 is inserted into the through-hole 521*d*. A bolt hole 51*c* that is threaded on the inside is formed in the second end 51*b* of the first member 51. The bolt 83 that has been passed through the through-hole 521*d* is inserted into the bolt hole 51*c*. A washer 85 is disposed between the bolt head 83*a* of the bolt 83 and the ball component 521*b*, and a washer 86 is disposed between the ball component 521*b* and the second end 51*b*.

Because the first ball joint 521 is disposed more to the boom 7 side (that is, to the inside, or to the side facing the second vertical plate 12*b*) than the second end 51*b* of the first member 51, the second member 52 is disposed more to the boom 7 side than the first member 51.

With this configuration, the first member 51 and the second member 52 are rotatably linked together. The axis that serves as the rotational center here is indicated by 50*a* in FIGS. 7A, 7B, and 8.

Next, the connection between the second ball joint 522 and the link fixing member 70 will be described.

As shown in FIG. 3, the link fixing member 70 is a Z-shaped member that is formed by bending a slender, flat member. The link fixing member 70 is disposed in the lengthwise direction of the first boom component 7*b*, on a side face 7*e* of the first boom component 7*b*. The link fixing member 70 has a boom-side fixing component 71, a perpendicular part 73, a link connector 72, and a rib 75.

The boom-side fixing component 71 is fixed by bolts 74 to the side face 7*e* of the boom 7. The perpendicular part 73 is formed facing in the substantially perpendicular direction (to the right) with respect to the side face 7*e* from the rear side of the boom-side fixing component 71. The link connector 72 is formed to extend from the distal end of the perpendicular part 73 toward the proximal end 7*d* side of the boom 7.

As shown in FIG. 8, the second ball joint 522 has a support component 522*a* and a ball component 522*b*. The support component 522*a* is connected to the connecting member 523. A substantially spherical support space 522*c* is formed in the distal end portion of the support component 522*a*, and the ball component 522*b* is rotatably supported in this support space 522*c*. A through-hole 522*d* is formed in the ball component 522*b*, and the bolt 84 is inserted into the through-hole 522*d*.

The rib 75 sticks out from the outer peripheral face 72*a* of the link connector 72 of the link fixing member 70 (the face on the opposite side from the second vertical plate 12*b*). A bolt hole 75*a* is formed in the rib 75. The bolt 84 that has been passed through the through-hole 522*d* is inserted into the bolt hole 75*a*. A washer 87 is disposed between the bolt head 84*a* of the bolt 84 and the ball component 522*b*, and a washer 88 is disposed between the ball component 522*b* and the second end 51*b*.

The center axis of the second ball joint 522 is shown in the drawings as the axis 50*b*.

Because the two ends of the second member 52 are constituted by ball joints, they can absorb vibration of the boom 7 to the left and right during work, which reduces the effect this vibration will have on the rotary encoder 40.

Figure 9:
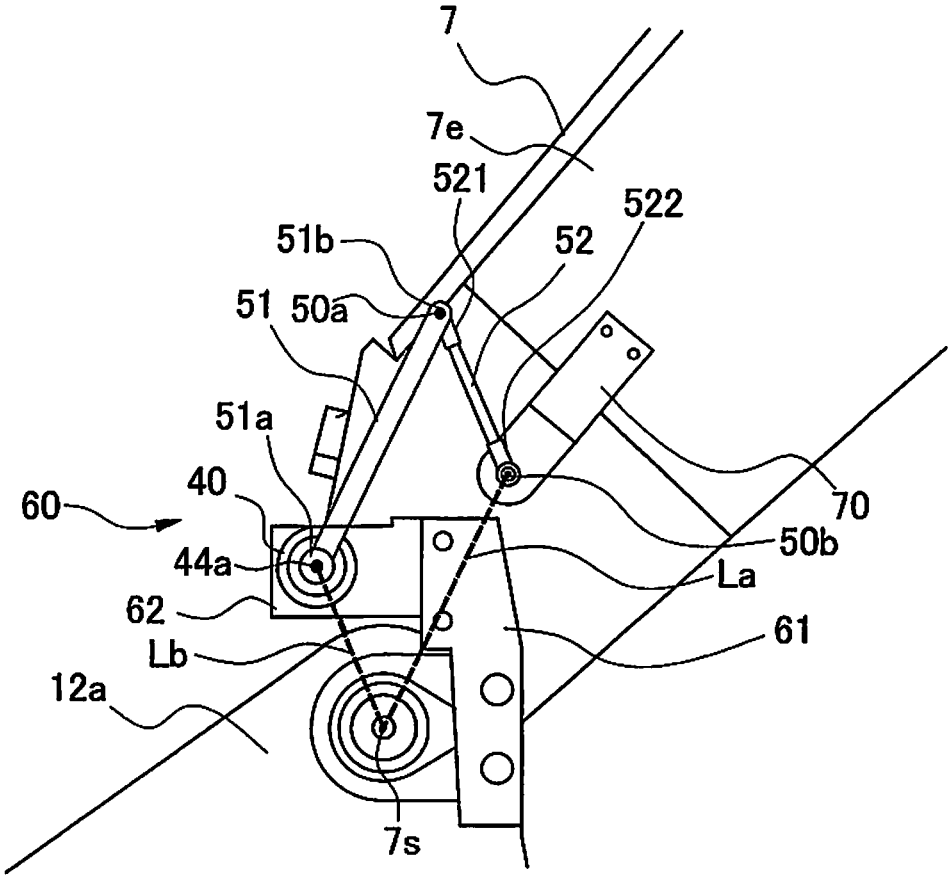
FIG. 9 is a side view of the configuration near the link member in FIG. 3.

FIG. 9 is a simplified diagram of near the encoder, as seen from the right side. In FIG. 9, the rotary encoder 40 is hidden by the second bracket member 62, but the rotary encoder 40 is drawn with solid lines to show positional relations of the rotary encoder 40, the link member 50, and the axis 7*s*. The same applies to FIGS. 10A and 10B below.

As shown in FIG. 9, when viewed from the right side (the direction perpendicular to the first vertical plate 12*a*), the first member 51 is disposed parallel to a line segment La, and is the same length as the line segment La, which connects the axis 7*s* (rotational axis) of the boom 7 and an axis 50*b*, which is the linked portion of the link fixing member 70 and the second member 52.

The second member 52 is disposed parallel to a line segment Lb, and is the same length as the line segment Lb, which connects the axis 7*s* (rotational axis) of the boom 7 and an axis 44*a*, which is the center of the shaft 44 of the rotary encoder 40.

Since the second member 52 is thus the same length as and parallel to the line segment Lb, and the first member 51 is the same length as and parallel to the line segment La, the straight lines connecting the axis 44*a*, the axis 7*s*, the axis 50*b*, and the axis 50*a* form a parallelogram as viewed from the right-side face (the direction perpendicular to the first vertical plate 12*a*).

2. Operation

Figure 10A:
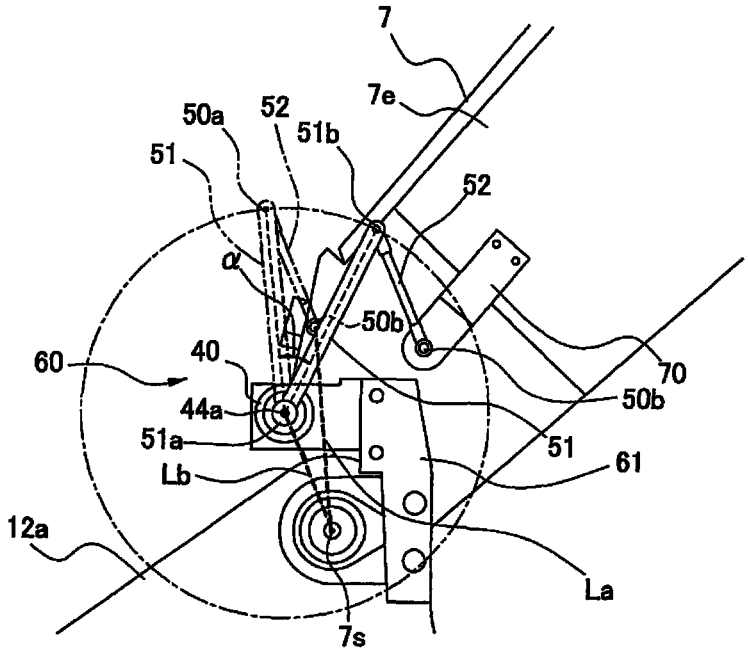
FIG. 10A is a side view of the configuration near the link member in FIG. 3 showing maximum upward rotation.
Figure 10B:
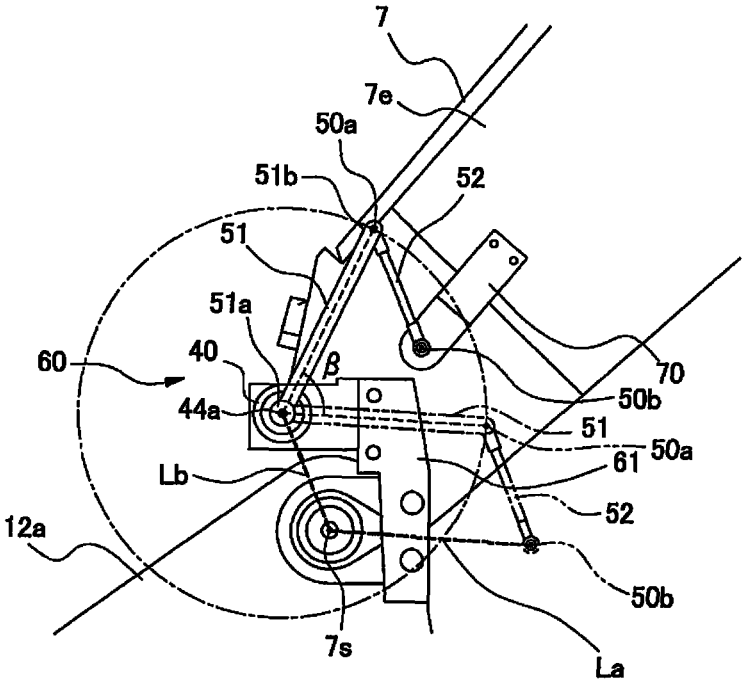
FIG. 10B is a side view of the configuration near the link member in FIG. 3 showing maximum downward rotation.

FIGS. 10A and 10B are simplified diagrams of the state of the link member 50 when the boom 7 has been rotated. In FIGS. 10A and 10B, the link member 50 is drawn in solid lines when the boom 7 is in a specific position. In FIG. 10A, the link member 50 is drawn in two-dot chain lines when the boom 7 has rotated upward as far as it will go. In FIG. 10B, the link member 50 is drawn in two-dot chain lines when the boom 7 has rotated downward as far as it will go.

As shown in FIGS. 10A and 10B, when the boom 7 rotates, the link member 50 rotates along with the boom 7 while keeping the first member 51 parallel to the line segment La and keeping the second member 52 parallel to the line segment Lb. In the rotation of the boom 7, the tetragonal shape obtained by connecting the axis 44*a*, the axis 7*s*, the axis 50*b*, and the axis 50*a* in that order with straight lines is always a parallelogram as seen from the right-side face (the direction perpendicular to the first vertical plate 12*a*). At this point, the second end 51*b* of the first member 51 linked to the second member 52 rotates around the periphery (one-dot chain line) around the first end 51*a*, which is the portion linked to the rotary encoder 40.

In the rotation of the boom 7, since the first member 51 is kept parallel to the line segment La and the second member 52 is kept parallel to the line segment Lb, the rotational angle of the boom 7 is in a one-to-one correspondence with the rotational angle of the first member 51.

The rotational angle of the first member 51 when the boom 7 has rotated upward as far as it will go from the above-mentioned specific position is indicated as α in FIG. 10A, and the rotational angle of the boom 7 at this point is also α. The rotational angle of the first member 51 when the boom 7 has rotated downward as far as it will go from the above-mentioned specific position is indicated as β in FIG. 10B, and the rotational angle of the boom 7 at this point is also β.

During operation of the hydraulic excavator 100, when the boom 7 rotates up and down, the rotation of the boom 7 is accompanied by movement of the link member 50. As discussed above, the rotational angle of the first member 51 of the link member 50 is in a one-to-one correspondence with the rotational angle of the boom 7.

3. Features, Etc.

3-1

The hydraulic excavator 100 (an example of a work vehicle) in the above exemplary embodiment comprises the revolving frame 10 (an example of a frame), the boom 7, the rotary encoder 40 (an example of an angle sensor), and the link member 50. The revolving frame 10 has the first vertical plate 12*a* and the second vertical plate 12*b* that are opposite each other. The boom 7 is rotatably supported by the first vertical plate 12*a* and the second vertical plate 12*b*. The rotary encoder 40 is provided at a different position from a position of the axis 7*s* (an example of a rotational axis). The link member 50 transmits the rotational angle of the boom 7 to the rotary encoder 40 according to the rotation of the boom 7.

Thus providing the link member 50 to transmit the rotational angle of the boom 7 to the rotary encoder 40 allows the rotary encoder 40 to be installed at a position that is different from that of the axis 7*s*, which is the rotational axis of the boom 7. Consequently, the position of the rotary encoder 40 can be moved from the rotational axis of the boom 7 as dictated by the parts that are disposed near the axis 7*s*, which is the rotational center of the boom 7. Therefore, the space to the side of the axis 7*s* of the boom 7 (the outside of the first vertical plate 12*a*) can be utilized effectively.

3-2

With the hydraulic excavator 100 in the above exemplary embodiment, the rotary encoder 40 is disposed higher than the axis 7*s*.

This allows parts to be disposed near and to the side of the first vertical plate 12*a*, so the space to the side of the axis 7*s* (to the outside of the first vertical plate 12*a*) can be utilized effectively.

3-3

The hydraulic excavator 100 in the above exemplary embodiment further comprises the reductant tank 15 (an example of a tank). The reductant tank 15 is disposed to the side of the first vertical plate 12*a* and on the revolving frame 10. The rotary encoder 40 is disposed higher than the reductant tank 15.

Consequently, since the reductant tank 15, a fuel tank, or another such tank can be disposed near and to the side of the first vertical plate 12*a*, the space to the outside of the first vertical plate 12*a* can be utilized effectively.

3-4

The hydraulic excavator 100 in the above exemplary embodiment further comprises the bracket 60 (an example of a support member). The bracket 60 is fixed to the first vertical plate 12*a*, and is a flat member that supports the rotary encoder 40. The rotary encoder 40 is disposed on the second vertical plate 12*b* side of the bracket 60.

Since the rotary encoder 40 is thus disposed on the second vertical plate 12*b* side of the bracket 60, the reductant tank 15 or other such parts can be disposed near and to the outside of the first vertical plate 12*a*, and the space to the outside of the first vertical plate 12*a* can be utilized effectively.

3-5

With the hydraulic excavator 100 in the above exemplary embodiment, the link member 50 has the first member 51 that is linked to the rotary encoder 40, and the second member 52 that is linked to the boom 7. The first member 51 and the second member 52 are rotatably linked together. The first member 51 is disposed parallel to the line segment La that connects the axis 50*b* (an example of the linked portion of the second member and the boom) and the axis 7*s* (an example of the rotational axis of the boom), and the second member 52 is disposed parallel to the line segment Lb that connects the axis 44*a* (an example of the linked portion of the angle sensor and the first member) and the axis 7*s* (an example of the rotational axis of the boom).

This creates a parallel link, so the rotational angle of the boom 7 can be in a one-to-one correspondence with the angle sensed by the rotary encoder 40, and the rotational angle of the boom 7 can be the same as the angled sensed by the rotary encoder 40. The term "parallel" here permits a certain amount of mechanical error.

4. Other Exemplary Embodiments

An exemplary embodiment of the present invention is described above, but the present invention is not limited to or by this exemplary embodiment, and various modifications are possible without departing from the gist of the invention.

(A)

In the above exemplary embodiment, the link member 50 is linked to the boom 7 via the link fixing member 70, but depending on the distance between the link member 50 and the side face of the boom 7, the link member 50 may be linked directly to the boom 7.

(B)

In the above exemplary embodiment, the first member 51 is linked to the rotary encoder 40 at the first end 51*a*, and is linked to the second member 52 at the second end 51*b*, but need not be linked at the ends, and may extend beyond the linked portion of the rotary encoder 40 and the second member 52.

(C)

In the above exemplary embodiment, the bracket 60 is constituted by two members, namely, the first bracket member 61 and the second bracket member 62, that are linked together, but may instead be a single member. Dividing into two members makes it easier to accommodate work vehicles of different sizes and types. More precisely, the structure of the first bracket member 61 to which the rotary encoder 40 is attached is more complicated than that of the second bracket member 62. Accordingly, when the first bracket member 61 is a shared part, work vehicles of different sizes and types can be easily accommodated by changing the size of the second bracket member 62 (a flat member).

(D)

Figure 11:
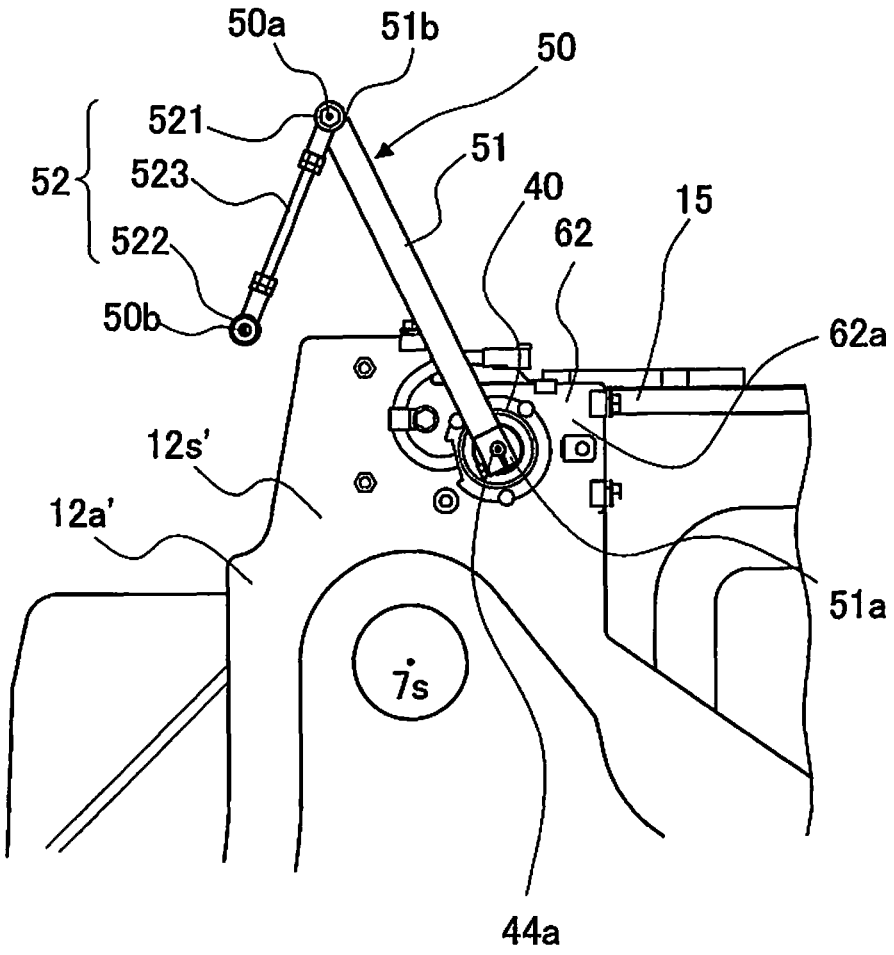
FIG. 11 is a side view of near the rotary encoder of the hydraulic excavator in a modification example in an embodiment pertaining to the present invention.

In the above exemplary embodiment, the rotary encoder 40 is attached to the bracket 60 that is fixed to the first vertical plate 12*a*, but may instead be attached directly to the first vertical plate. FIG. 11 shows the state when the rotary encoder 40 is attached to a first vertical plate 12*a*'. The first vertical plate 12*a*' shown in FIG. 11 is formed extending higher than the first vertical plate 12*a* in Embodiment 1 above, and the rotary encoder 40 is attached to a face 12*s*' on the inside (the second vertical plate 12*b* side) of the first vertical plate 12*a'*.

(E)

In the above exemplary embodiment, the link member 50 of the present invention is applied to the rotary encoder 40 (an example of an angle sensor) for calibrating the position sensor 24 of the boom cylinder 21, but the present invention may also be applied to a rotary encoder that is provided to the axis 8*a* of the arm 8. In this case, an example of a rotary member is the arm 8, and an example of a frame is the boom 7.

(F)

In the above exemplary embodiment, the description is of the rotary encoder 40 for calibrating the position sensor 24, but the rotary encoder 40 for calibrating the position sensor 24 is not the only option. In other words, any rotary encoder for sensing the rotational angle of a rotary member may be used.

(G)

In the above exemplary embodiment, the rotary encoder 40 and the link member 50 are described using a hydraulic excavator as an example of a work vehicle, but it is not limited to being a hydraulic excavator, and the present invention may be applied to some other work vehicle.

The work vehicle of the present invention has the effect of allowing the space to the outside of a vertical plate to be utilized effectively, and can be applied to hydraulic excavators and the like.

The invention claimed is:

1. A work vehicle, comprising:

a frame having a first vertical plate and a second vertical plate that are opposite each other;

a boom rotatably supported by the first vertical plate and the second vertical plate;

an angle sensor disposed at a different position from a position of a rotational axis of the boom;

a link member transmitting a rotational angle of the boom to the angle sensor according to a rotation of the boom;

a tank disposed on the frame and to a side of the first vertical plate; and a flat support member fixed to the first vertical plate to support the angle sensor;

the angle sensor being disposed on the flat support member higher than the tank.

2. The work vehicle according to claim 1, wherein the angle sensor is disposed higher than the rotational axis.

3. The work vehicle according to claim 1, wherein the tank is a reductant tank.

4. The work vehicle according to claim 1, wherein the angle sensor is disposed on the second vertical plate side of the flat support member.

5. The work vehicle according to claim 1, wherein the link member includes a first member linked to the angle sensor; and a second member linked to the boom, the first member and the second member being mutually rotatably linked, the first member being disposed substantially parallel to a straight line that connects the rotational axis of the boom with a linked portion of the second member and the boom, and the second member being disposed substantially parallel to a straight line that connects the rotational axis of the boom with a linked portion of the angle sensor and the first member.

* * * * *